US009302827B1

(12) United States Patent
Goss et al.

(10) Patent No.: US 9,302,827 B1
(45) Date of Patent: Apr. 5, 2016

(54) DISPENSING CAP UNIT

(71) Applicant: Merideth Springfield, Ludlow, MA (US)

(72) Inventors: Richard A. Goss, Pewaukee, WI (US); Dieter F. Lay, Oconomowoc, WI (US)

( * ) Notice: Subject to any disclaimer, the term of this patent is extended or adjusted under 35 U.S.C. 154(b) by 0 days.

(21) Appl. No.: 13/987,490

(22) Filed: Jul. 31, 2013

(51) Int. Cl.

| | |
|---|---|
| ***B67D 3/00*** | (2006.01) |
| ***B65D 47/32*** | (2006.01) |
| *B65D 47/04* | (2006.01) |
| *B65D 51/16* | (2006.01) |

(52) U.S. Cl.
CPC ..... *B65D 47/32* (2013.01); *B65D 47/043* (2013.01); *B65D 51/16* (2013.01)

(58) Field of Classification Search
CPC ..... B65D 2205/00; B65D 47/0842; B65D 47/32; B65D 47/04; B65D 47/043; B65D 51/16
USPC ..... 222/108, 111, 143.05, 481.5, 482, 485, 222/507, 536, 541.6, 543, 556, 568, 571
See application file for complete search history.

(56) References Cited

U.S. PATENT DOCUMENTS

| | | | | |
|---|---|---|---|---|
| 234,959 | A | 11/1880 | Chalk | |
| 1,436,708 | A | 11/1922 | Goebel | |
| 1,667,821 | A | 5/1928 | Rhodes | |
| 2,237,810 | A | 4/1941 | Casper | |
| 2,497,134 | A | 2/1950 | Muenze | |
| 2,536,160 | A * | 1/1951 | Duggan | 222/81 |
| 3,040,938 | A | 6/1962 | Smith | |
| 3,371,827 | A * | 3/1968 | Micallef | 222/507 |
| 4,105,148 | A | 8/1978 | Williams | |
| 4,241,855 | A * | 12/1980 | Yoshioka | 222/479 |
| 4,452,381 | A | 6/1984 | Freeman | |
| 4,741,459 | A | 5/1988 | Silvenis et al. | |
| D367,611 | S | 3/1996 | Wagner, III et al. | |
| 5,605,254 | A * | 2/1997 | Wagner et al. | 222/108 |
| 6,926,179 | B2 * | 8/2005 | Wagner et al. | 222/481.5 |
| D573,880 | S | 7/2008 | Clause et al. | |
| 2004/0050883 | A1 * | 3/2004 | Wagner et al. | 222/484 |

* cited by examiner

*Primary Examiner* — Frederick C Nicolas
*Assistant Examiner* — Bob Zadeh
(74) *Attorney, Agent, or Firm* — Paul R. Martin

(57) ABSTRACT

A dispensing cap unit for use on a liquid container which permits a smooth flow of liquid out of the container when the container is rapidly inverted. The dispensing cap unit includes an air vent passage located inside the outer wall of the unit and is separated from the liquid flow path by a partition wall which terminates short of the lower end of the outer wall. A baffle element extends across the air vent passage adjacent to the end of the partition wall to define, with the end of the partition wall, an air vent passage outlet port which is oriented so that liquid is not likely to flow into the air vent passage via the air vent passage outlet port.

12 Claims, 6 Drawing Sheets

DISPENSING CAP UNIT

TECHNICAL FIELD OF THE INVENTION

Figure 1:
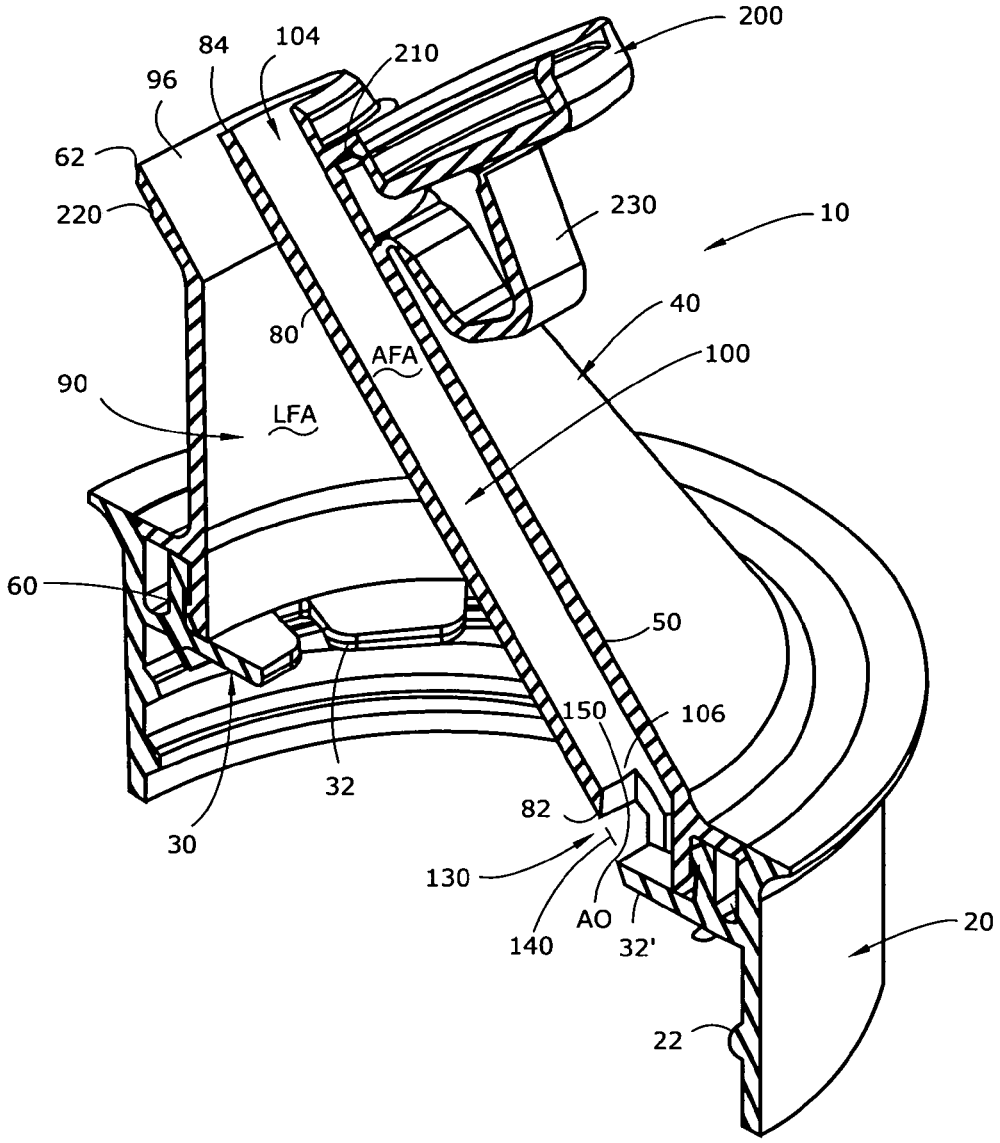

The present invention relates to the general art of dispensing, and to the particular field of liquid dispensers.

BACKGROUND OF THE INVENTION

Many liquids such as drink mixers as well as soda, fruit juices, mixtures, beer and the like are distributed in containers having a dispensing portion which terminates with an external lip over which a closure element, such as a cap, is fastened. To dispense the liquid from the container, the container is tilted at a slight angle so that the liquid does not fill the neck portion entirely. A container is tilted similarly so that the liquid does not entirely cover the end opening. This allows air to enter the container to replace the liquid flowing out. Tilting the container at a greater angle increases the speed of the flow as the fluid pressure at the opening is increased. However, if the container is tilted at too great an angle the liquid entirely fills the opening and air cannot continuously enter to replace the liquid which is flowing out. As a consequence, periodically the flow of liquid is interrupted while air surges into the container, thereby creating a pulsed flow of liquid. This limits the speed at which the container can be emptied. This pulsating flow is especially present when a person rapidly inverts the container as may be done by a bartender in a process known as "slamming". Any advantage gained by the rapid inversion is negated by the air impeded flow of liquid out of the container.

The inventor is aware of several dispensing systems, such as the systems disclosed in U.S. Pat. Nos. 4,452,381, 5,605,254, 6,926,179, 5,326,003, 2,545,350 as well as U.S. Pat. No. 3,338,482 which provide a vent of some sort that is fluidically connected to the dispensing opening of a beverage container whereby air is continuously added to the container as fluid is dispensed with the objective being to produce a smooth flow of fluid out of the container.

While functioning to prevent pulsating flow, these known dispensing systems have their own drawbacks. One such drawback occurs during the above-mentioned slamming process because the liquid flows out of the container so fast that it can actually clog any air discharge vent and impede the flow of air into the container. Furthermore, with these prior art systems, rapid use of the system can easily cause a part of the liquid contents of the system to be discharged out of the air vent channel or orifice, and in a direction such that it does not enter the shot glass, tumbler or other receptacle into which the liquid is to be directed. Instead, the liquid which is thus sloshed out of the air channel or vent may splatter on a customer, on the bartender or on the bar itself. Whatever the ultimate repository of the errant liquid content of the container, such construction is undesirable because of this lack of control.

Therefore, there is a need for a beverage dispensing system that permits smooth flow of a liquid from a container even during a rapid liquid dispensing process.

SUMMARY OF THE INVENTION

The above-discussed disadvantages of the prior art are overcome by a dispensing cap unit for use on a liquid container which permits a smooth flow of liquid out of the container, even if the container is rapidly inverted. The dispensing cap unit includes an air vent passage that is located inside the outer wall of the unit and is separated from the liquid flow path by a partition wall. The partition wall terminates short of a plane containing the lower end of the outer wall and an obstruction element is located adjacent to the lower end of the outer wall. One part of the obstruction element extends across the end of the air vent passage so the end of the air vent passage is obstructed with respect to liquid flowing out of the container via the cap unit. Termination of the partition wall short of the lower end of the outer wall causes the lower end of the partition wall to cooperate with the obstruction element obstructing the air vent passage to define an air vent outlet port that faces across the axis of fluid passage toward the outer wall with the fluid passage being interposed between the air vent passage outlet port and the outer wall. The air vent passage outlet port is defined in the partition wall and is thus oriented at an angle to the end of the air inlet vent, the obstruction element covers the end of the air inlet vent and directs liquid flow away from the air vent outlet port when liquid is flowing out of the container via the dispensing cap unit. Liquid flowing out of the container is diverted away from entering the air vent passage via the air vent outlet port and, in some cases, this liquid diversion may actually establish a pressure gradient across the air vent passage outlet port which assists air flow out of the air vent outlet port. The unit further includes a second baffle plate located near the inlet of the air vent passage to divert liquid away from the inlet of the air vent passage inlet. Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

Figure 2:
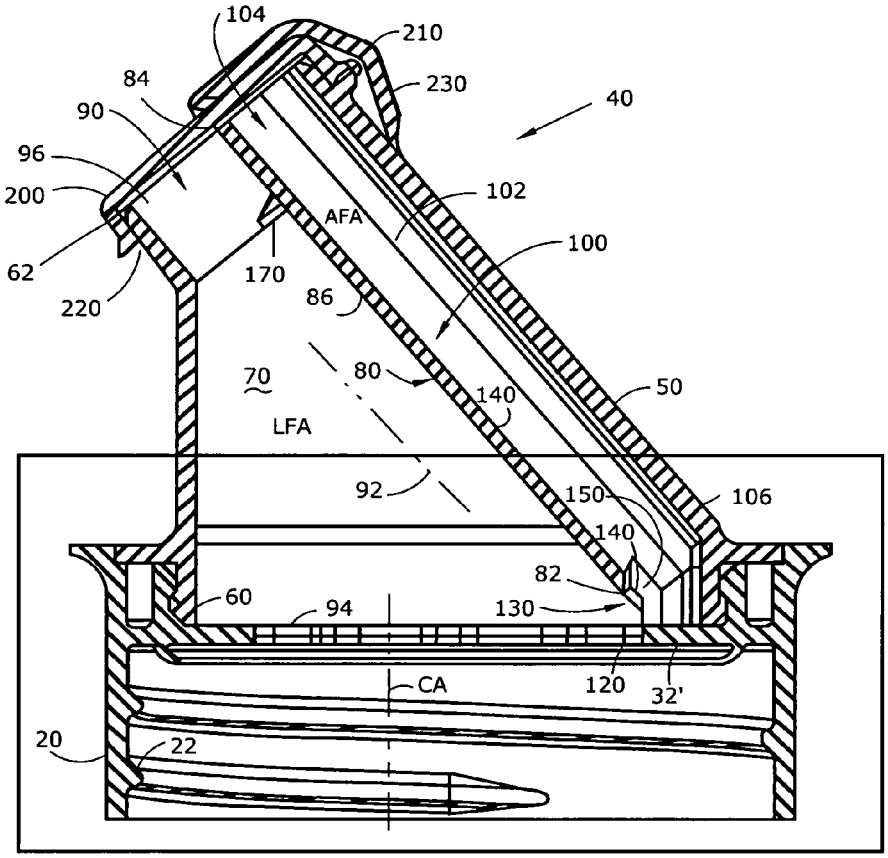
Figure 3:
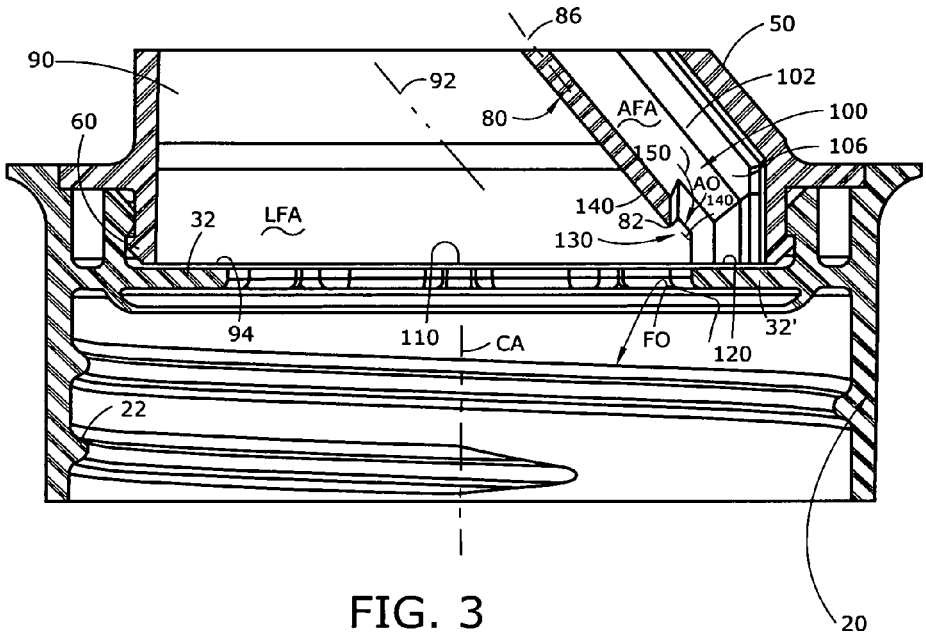
Figure 4:
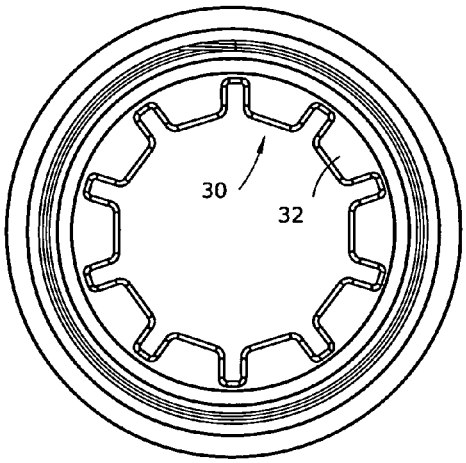
Figure 6:
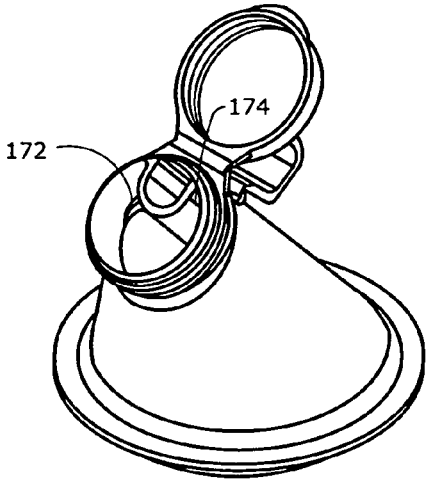
Figure 5:
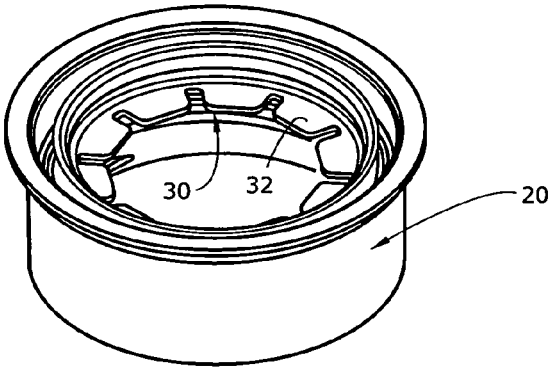
Figure 7:
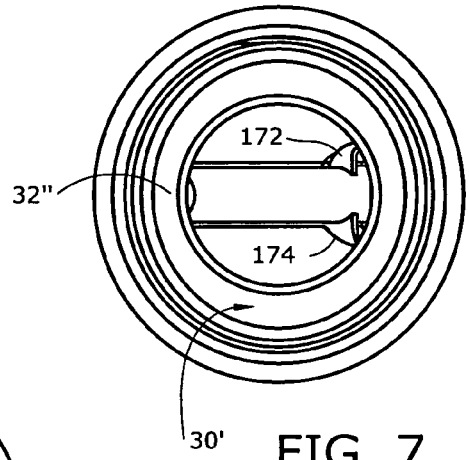
Figure 9:
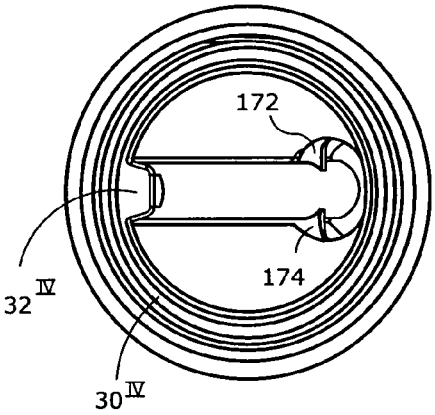
Figure 10:
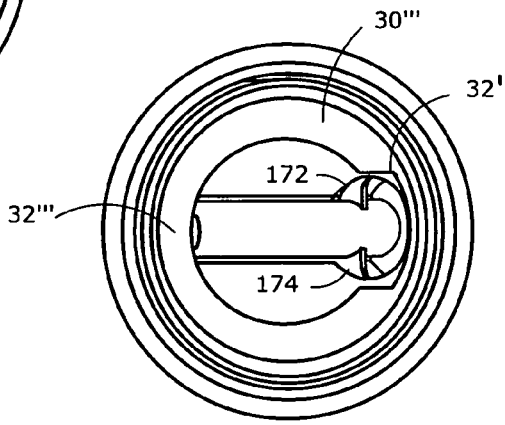
Figure 8:
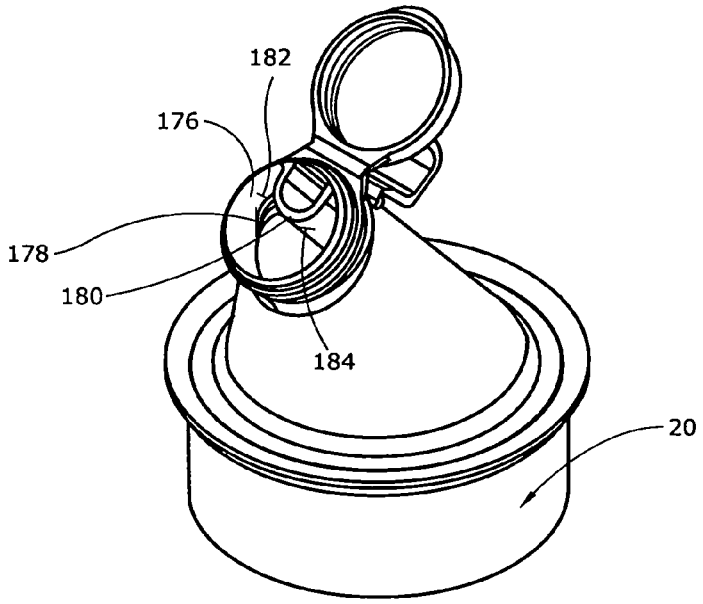
Figure 11:
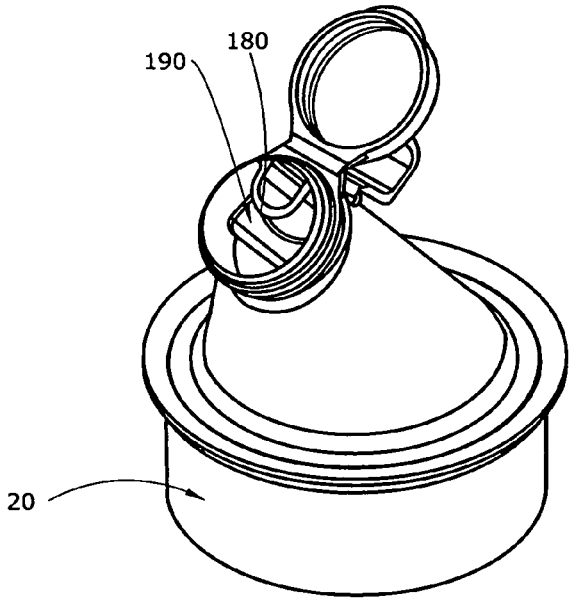

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views. FIG. 1 is a cut away perspective view of a dispensing cap unit embodying the present invention, with the closure cap in the open condition. FIG. 2 is a cut away side elevational view of the dispensing cap unit, with the closure cap in the closed condition. FIG. 3 is a cut away enlarged view of a portion of the dispensing cap unit showing the air vent passage outlet port. FIG. 4 shows a baffle plate which is included in the dispensing cap unit. FIG. 5 is a perspective view of the baffle plate inside the base element of the dispensing cap unit. FIG. 6 is a perspective view of one form of the dispensing cap unit. FIG. 7 shows another form of the dispensing cap unit as seen from inside the container. FIG. 8 is a perspective view of the form of the dispensing cap unit shown in FIG. 6 in combination with a base element. FIG. 9 shows another form of the dispensing cap unit. FIG. 10 shows another form of the dispensing cap unit. FIG. 11 is a perspective view of another form of the dispensing cap unit.

DETAILED DESCRIPTION OF THE INVENTION

Referring to the figures, it can be understood that the present invention is embodied in a dispensing cap unit 10 for use on a liquid container C and which permits a smooth flow of liquid even when the container is overturned rapidly. The cap unit comprises a base element 20 which is attached to the liquid container when in use as by threads 22 on the base unit cooperating with threads on the container. An annular obstruction element, such as baffle 30, is attached to the base element. The obstruction element can be one-piece. The baffle plate shown has a plurality of of spaced apart baffle elements, such as baffle elements 32 and 32', which extend radially inward of the cap unit. Baffle plate 30 is one form of the obstruction element and other forms will be discussed below. The preferred form of the invention includes a baffle plate having a plurality of spaced-apart baffle elements; accordingly, for the sake of convenience, the initial portion of this disclosure will refer to a baffle plate having a plurality of spaced-apart baffle elements; however, it should be understood that this description is for the sake of convenience. As best shown in FIGS. 1-3, a hollow fluid dispenser unit 40 is unitary with the base element when in use and includes an outer wall 50 having a first end 60 attached to the base element when the dispenser unit is in use and a second end 62 spaced apart from the first end. The outer wall defines a passage area 70 within the outer wall. A partition wall 80 is located inside the passage area and extends in the direction of the outer-wall. In one form of the invention, the partition wall extends parallel to the outer wall. As will be understood from the teaching of this disclosure, the partition wall divides the passage area into a liquid flow area LFA and an air flow area AFA. The partition wall has a first end 82 located adjacent to first end 60 of the outer wall and a second end 84 which is spaced apart from the first end of the partition wall. The partition wall is spaced apart from the outer wall and has a partition wall axis 86 which extends from the first end of the partition wall to the second end of the partition wall. A fluid passage 90 is defined by the outer wall and the partition wall and extends from first end 60 of the outer wall to second end 62 of the outer wall and has a fluid passage axis 92 which extends from the first end of the outer wall to the second end of the outer wall. In one form of the unit, fluid axis 92 extends at an oblique angle to container axis CA. However, it is noted that other forms of the invention can include a fluid passage axis which is aligned with the axis of the container without departing from the scope of this invention. As will be understood from the teaching of this disclosure, the cap will operate efficiently even when the two axes are aligned. Fluid passage 90 has a first fluid passage end 94 located adjacent to first end 60 of the outer wall and a second fluid passage end 96 located adjacent to second end 62 of the outer wall. An air vent passage 100 is defined by the outer wall and the partition wall and extends from first end 82 of the partition wall to second end 84 of the partition wall and has an air vent axis 102 which extends from first end 82 of the partition wall to second end 84 of the partition wall. The air vent passage has a first air vent passage end 104 located adjacent to second end 84 of the partition wall and a second air vent passage end 106. It is noted that the terms "first end" and "second end" are taken in reference to flow direction of fluid flowing in the channel of interest. Therefore, since liquid is flowing in fluid passage 90 from the container from end 60 to end 62, end 60 will be referred to as the "first end" and end 62 will be referred to as the "second end;" whereas, since air is flowing into the container in air vent passage 100 from end 104 toward end 106, end 104 will be referred to as the "first end" of the air vent passage and end 106 will be referred to as the "second end" of the air vent passage. As is best shown in FIG. 3, first end 82 of the partition wall is spaced apart from a plane 110 containing the first end of the outer wall. The baffle plate has baffle element 32' which is located in a plane 120 located adjacent to and spaced-apart from first end 82 of the partition wall and which extends transverse to fluid passage axis 92 and across air vent passage second end 106 for a purpose which will be better understood from the teaching of the following description. The first end of the partition wall and baffle element 32' define a gap 130 which extends in the direction of the partition wall axis from baffle element 32' to first end 82 of the partition wall. In the form of the cap unit shown in FIGS. 1-3, the partition wall is semi-circular. A plane 140 is tangent to the partition wall at a location closest to the fluid passage axis 92 and extends perpendicular to the plane of the paper of FIG. 3. Gap 130 functions as an outlet port for the air vent passage. As can be understood from the foregoing and from FIG. 3, plane 140 intersects gap 130. The gap defines a path 150 from the air vent passage to the fluid passage which extends in a direction transverse to the fluid passage axis and through which air flows into the container while liquid is being dispensed out of the container via cap dispenser unit 40. The air vent passage outlet port has a location and orientation so that air flowing in the air vent passage in direction AF from the second end of the air vent passage towards the first end of air vent passage flows out of the gap in a direction AO which is transverse to the fluid passage axis and fluid flowing in the fluid passage in direction FO flows in a direction which is transverse to the air flowing out of the air vent passage outlet port. As indicated by fluid flow direction FO in FIG. 3, baffle element 32' and the orientation of gap 130 facing across the flow path of liquid flowing out of the container via the dispensing cap unit cooperate with each other so that fluid flowing in the fluid passage is directed by baffle element 32' away from the air vent passage outlet port and is obstructed by the baffle element and the orientation of the gap relative to the direction of flow of the fluid in the fluid passage against flowing into the air vent passage via the air vent passage outlet port. In some cases, the diversion of fluid away from the gap 130 may even create a pressure gradient across the gap which assists air flow out of the air vent passage outlet port. One form of the cap unit further includes second baffle unit 170 located adjacent to the second end of the air vent passage. The function of the second baffle unit is to direct fluid flowing in flow passage 90 in the direction of the fluid passage axis (direction FO, see FIG. 3) out of the fluid passage away from air vent passage first end 104 which is the inlet of the air vent passage. This prevents liquid from splashing into the air vent inlet during a pouring operation where liquid is dispensed form the container via the dispensing cap unit. A first form of the second baffle unit is shown in FIG. 8 and includes two spaced-apart baffle plate elements 172 and 174 each located adjacent to the partition wall near the second end of the fluid passage and the first end of the air vent passage. The two baffle plate elements 172 and 174 are sized to define a large spout opening. More specifically, baffle plate elements 172 and 174 extend radially inward from inner surface 176 of outer wall 50 and each has an edge 178 which is located adjacent to location 180 on partition wall 80. In the form of the dispensing cap unit having a semi-circular partition wall, location 180 is located by a line 182 which extends in plane 184 which is parallel to plane 140 and is tangent to the partition wall at a location spaced farthest from inner surface 176 whereby the baffle plate elements 172 and 174 are located beside the partition wall but do not extend beyond the partition wall toward fluid passage axis 92.

Another form of the cap unit is shown in FIG. 9 and includes an obstruction element $\mathbf{30}^{IV}$ which is one piece and includes a single projection tab $\mathbf{32}^{IV}$ located to obstruct the air vent passage outlet in the manner of element $\mathbf{32}^{IV}$ shown in FIGS. 1 and 2. A second form of the second baffle unit is shown in FIG. 11 and includes a one-piece baffle plate element 190 which extends beyond location 180 on the partition wall toward axis 92 of the fluid passage and partially obstructs that passage whereby a reduced spout opening is defined. Other forms of the obstruction element are shown in FIGS. 7 and 10. The form of the obstruction element shown in FIG. 7 includes a one-piece annular ring 30' which is located where baffle plate 30 is in the unit shown in FIGS. 1-3. Obstruction element 30' has an obstruction portion 32" located to obstruct the outlet of the air vent port as discussed above in regard to baffle element 32'. Obstruction portion 32" operates and functions in a manner identical to the operation and function of baffle element 32'. As such, this operation, structure and function will not be further discussed as one skilled in the art will be able to understand this from the teaching of this disclosure. Yet another form of the obstruction element is shown in FIG. 10. Obstruction element 30'" is shown in FIG. 10 as being one-piece, similar to obstruction element 30", but which includes a cutout area 321. Obstruction element 30'" also includes an obstruction portion 32"" located adjacent to the air vent outlet and operates and functions in a manner identical to baffle element 32'. As such, this operation, structure and function will not be further discussed as one skilled in the art will be able to understand this from the teaching of this disclosure. Dispensing cap unit 40 can include a cap 180 which is movably mounted on the outer wall by a hinge 190 and is movable between a covering position (FIG. 2) covering the second end of the partition wall and the second end of the outer wall and an uncovering position (FIG. 1) spaced apart from the second end of the partition wall and the second end of the outer wall. In one form of the unit, the second end of the fluid passage and the first end of the air vent passage are co-planar with each other with both passages being located inside the outer wall. The co-planar orientation of these passage ends allows the cap to cover both passages in a secure manner when the cap is in the covering position. A seal 200 can be located on the outer wall and is located to be interposed between the cap and the outer wall when the cap is in the covering position. In one form of the unit a snap hinge 210 connects the cap to the outer wall and operates so that the cover is held open when the cover is in the open position and is also held closed when the cover is in the closed position. While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A dispensing cap unit, comprising:

A) a base element;

B) a baffle attached to the base element and having a first baffle element and a second baffle element; and C) a hollow fluid dispenser unit on the base element comprising:

(1) an outer wall having a first end attached to the base element, the outer wall having a second end spaced apart from the first end and defining a passage area within the outer wall;

(2) a partition wall located inside the passage area, the partition wall extending in a direction of the outer wall and having a first end located adjacent to the first end of the outer wall and a second end, the second end of the partition wall being spaced apart from the first end of the partition wall, the partition wall being spaced apart from the outer wall and having a partition wall axis which extends from the first end of the partition wall to the second end of the partition wall;

(3) a fluid passage defined by the outer wall and the partition wall which extends from the first end of the outer wall to the second end of the outer wall and which has a fluid passage axis which extends from the first end of the outer wall to the second end of the outer wall, the fluid passage having a first fluid passage end located adjacent to the first end of the outer wall and a second fluid passage end located adjacent to the second end of the outer wall;

(4) an air vent passage defined by the outer wall and the partition wall which extends from the first end of the partition wall to the second end of the partition wall and which has an air vent axis which extends from the first end of the partition wall to the second end of the partition wall, the air vent passage having a first air vent passage end located adjacent to the second end of the partition wall and a second air vent passage end, wherein the second end of the fluid passage and the first end of the air vent passage are co-planer with each other;

(5) the first end of the partition wall being spaced apart from a plane containing the first end of the outer wall;

(6) the first baffle element being located in a plane located adjacent to and spaced apart from the first end of the partition wall and which extends transverse to the fluid passage axis and across the air vent passage second end;

(7) the first end of the partition wall and the first baffle element defining an air vent passage outlet port which extends in the direction of the partition wall axis from the first baffle element to the first end of the partition wall, the air vent passage outlet port being defined in the partition wall to be located and oriented to face transverse to the fluid flow passage axis, the air vent passage outlet port defining a path from the air vent passage to the fluid passage which extends in a direction transverse to the fluid passage axis;

(8) the air vent passage outlet port being located in the partition wall and facing transverse to the flow axis of fluid flowing in the fluid passage directing air flowing in the air vent passage from the second end of the air vent passage towards the first end of air vent passage to flow out of the air vent passage outlet port in a direction which is transverse to the fluid passage axis whereby fluid flowing in the fluid passage flows in a direction which is transverse to the air flowing out of the air vent outlet port;

(9) the first baffle element and the air vent outlet port cooperating with each other so that fluid flowing in the fluid passage is directed by the first baffle element away from the air vent passage outlet port and is obstructed by the first baffle element and the orientation of the air vent passage outlet port relative to the direction of flow of the fluid in the fluid passage against flowing into the air vent passage via the air vent passage outlet port; and

(10) the second baffle element is located spaced apart from the first end of the air vent passage and extends transverse to the fluid passage axis and extends into the fluid passage whereby fluid flowing in the fluid passage in a direction from the first end of the fluid passage toward the second end of the fluid passage is obstructed against flowing into the first end of the air vent passage.

2. The dispensing cap unit defined in claim 1, further comprising a cap movably mounted on the outer wall and movable between a covering position covering the second end of the partition wall and the second end of the outer wall and an uncovering position spaced apart from the second end of the partition wall and the second end of the outer wall.

3. The dispensing cap unit defined in claim 2, further comprising a hinge connecting the cap to the outer wall.

4. The dispensing cap unit defined in claim 3, further comprising a seal on the outer wall, the seal being located to be interposed between the cap and the outer wall when the cap is in the covering position.

5. The dispensing cap unit defined in claim 2, having an annular baffle plate.

6. The dispensing cap unit defined in claim 5, wherein the annular baffle plate has a plurality of baffle elements.

7. The dispensing cap unit defined in claim 2, wherein the second baffle element includes two baffle elements each located adjacent to the first end of the air vent passage.

8. The dispensing cap unit defined in claim 3, wherein the hinge includes a snap hinge element so that the cover is held open when the cover is in the open position and is also held closed when the cover is in the closed position.

9. The dispensing cap unit defined in claim 1, wherein the partition wall extends in a direction which is parallel to the outer wall.

10. The dispensing cap unit defined in claim 1, wherein the air vent passage outlet port faces across the axis of fluid passage toward the outer wall with the fluid passage being interposed between the air vent passage outlet port and the outer wall.

11. The dispensing cap unit defined in claim 1, wherein the partition wall is semi-circular.

12. The dispensing cap unit defined in claim 1, wherein the second baffle element contains baffle plate elements spaced apart from each other.

* * * * *